US012467123B2

(12) United States Patent
Dunne et al.

(10) Patent No.: US 12,467,123 B2
(45) Date of Patent: Nov. 11, 2025

(54) BORONIZED CORROSION RESISTANT ALLOY COMPONENT FOR HIGH PRESSURE AND HIGH TEMPERATURE OILFIELD APPLICATIONS

(71) Applicants: CNPC USA CORP., Houston, TX (US); BEIJING HUAMEI, INC., Beijing (CN); CHINA NATIONAL PETROLEUM CORPORATION, Beijing (CN)

(72) Inventors: Timothy Ryan Dunne, Pearland, TX (US); Lei Zhao, Houston, TX (US); Jiaxiang (Jason) Ren, Houston, TX (US); Peng Cheng, Houston, TX (US)

(73) Assignees: CNPC USA CORPORATION, Houston, TX (US); BEIJING HUAMEI, INC., Beijing (CN); CHINA NATIONAL PETROLEUM CORPORATION, Beijing (CN); KEMBL PETROLEUM TECHNOLOGY DEVELOPMENT CO. LTD, Beijng (CN)

( * ) Notice: Subject to any disclaimer, the term of this patent is extended or adjusted under 35 U.S.C. 154(b) by 8 days.

(21) Appl. No.: 18/483,013

(22) Filed: Oct. 9, 2023

(65) Prior Publication Data

US 2025/0115986 A1 Apr. 10, 2025

(51) Int. Cl.
*E21B 23/01* (2006.01)
*C22C 19/05* (2006.01)
(Continued)

(52) U.S. Cl.
CPC ..... *C23C 8/70* (2013.01); *C22C 19/058* (2013.01); *C22C 30/00* (2013.01); *E21B 23/01* (2013.01); *E21B 33/129* (2013.01)

(58) Field of Classification Search
CPC ..... E21B 23/01; E21B 33/129; C22C 19/058; C22C 30/00; C23C 8/68; C23C 8/70
See application file for complete search history.

(56) References Cited

U.S. PATENT DOCUMENTS 10,060,192 B1 * 8/2018 Miess ..... B24D 99/005
2010/0276159 A1 11/2010 Mailand et al.
(Continued)

FOREIGN PATENT DOCUMENTS

WO WO-2021154170 A1 * 8/2021

OTHER PUBLICATIONS

The International search report and written opinion received on Mar. 15, 2024; Appln No. PCT/US2023/076381.

*Primary Examiner* — Matthew R Buck
(74) *Attorney, Agent, or Firm* — Frank Gao, Esq.

(57) ABSTRACT

A hardened slip and a method of making the hardened slip are disclosed. A method of hard surfacing a slip component for a downhole tool is disclosed. The slip component may have a bearing surface and may be composed of a base material, the base material being metallic. The method may comprise steps of positioning at least the bearing surface of the slip component with a direct contact with a boron source; bonding an external layer at least on the bearing surface to form a metallurgical bond between boron from the boron source with the base material by boriding the base material; and maintaining a bulk temperature of the slip component below a melting point of the base material.

20 Claims, 8 Drawing Sheets

(51) Int. Cl.

| | |
|---|---|
| ***C22C 30/00*** | (2006.01) |
| ***C23C 8/70*** | (2006.01) |
| ***E21B 33/129*** | (2006.01) |

(56) References Cited

U.S. PATENT DOCUMENTS

| | | | | |
|---|---|---|---|---|
| 2013/0260160 | A1* | 10/2013 | Yoon | B05D 7/14 148/279 |
| 2014/0216722 | A1* | 8/2014 | Badrak | C23C 14/46 166/206 |
| 2014/0216723 | A1* | 8/2014 | Badrak | B23K 9/042 427/580 |
| 2014/0262327 | A1* | 9/2014 | Xu | B22F 5/003 166/376 |
| 2014/0352943 | A1* | 12/2014 | Domec | E21B 19/10 166/77.51 |
| 2015/0060288 | A1* | 3/2015 | Sista | C25D 5/02 205/230 |
| 2018/0087345 | A1* | 3/2018 | Xu | E21B 33/1208 |
| 2018/0128073 | A1* | 5/2018 | Frazier | E21B 33/1208 |
| 2019/0136362 | A1* | 5/2019 | Domec | C23C 8/02 |

* cited by examiner

BORONIZED CORROSION RESISTANT ALLOY COMPONENT FOR HIGH PRESSURE AND HIGH TEMPERATURE OILFIELD APPLICATIONS

TECHNICAL FIELD AND INDUSTRIAL APPLICABILITY

The present invention relates generally to downhole tools in oil and gas field, and more particularly, to boronized or boriding corrosion resistant alloy component for high pressure and high temperature oilfield application.

BACKGROUND OF THE INVENTION

Downhole tools use slips to engage a casing and hold a downhole tool in place. For example, packers are a type of downhole tool that uses slips. Packers are used in oil and gas wells primarily to isolate different production zones. On the packer, a slip provides a frictional hold between the packer and casing or wellbore that helps keep the packer in place when subjected to high pressure, high temperature, and applied forces. The packer and associated slip is either permanent or retrievable.

Permanent packers are usually less expensive to manufacture and are typically capable of withstanding high pressure and temperature. In contrast, a retrievable packer can be "unset" by using hydraulic or mechanical means. After the packer is "unset," it can be brought uphole with tubing or a work string. Because it is designed to be reusable, a retrievable packer is, typically, more complex and has more mechanical parts.

Because it is permanent, a permanent packer is typically destroyed by milling or drilling to remove it. In other words, the permanent packer is designed for a single use and is destroyed to remove it. Thus, it is desirable to construct a permanent packer from materials that are more readily milled or drilled. Examples of materials that are more readily milled or drilled are made from non-metallic materials, such as composites, ceramics and plastics. Plastics such as ultra-high-molecular-weight polyethylene (UHMW), polytetrafluroethylene (PTFE) or similar engineering grade plastics can be used because of their high molecular weight and long molecular chains, although other thermoplastic polyethylenes might also be used.

Broadly speaking, more readily milled/drilled materials are weaker and are therefore less capable of carrying a load. Correspondingly, forming a permanent packer from more sturdy metallic materials makes the permanent packer stronger. However, the added strength means that it is more difficult to mill or drill the permanent packer to remove it. Added strength to the packer means that additional rig time is required to mill or drill the packer to remove it. Thus, there is an inherent contradiction between using permanent packers composed of metallic materials because it is significantly more time consuming to mill or drill when they are no longer needed. Because rig time is expensive, the added expense of additional rig time can be equal or exceed the savings of using a permanent packer as opposed to a retrievable packer.

The use of more durable metallic materials can also cause a problem known as "bit tracking" to occur when a drilling or milling a metallic material. During bit tracking, the drill bit used to mill out the tool stays on one path and no longer cuts the material to be drilled or milled. When this happens, it is appropriate to pick up the bit and rapidly recontact the material being drilled. During bit tracking, some material may be removed, but in actuality the drill bit is merely wearing against the surface of the downhole tool. Essentially, during bit tracking, the drill bit is rotating, but it is not appropriately cutting the packer or other material to be removed. Unfortunately, it might not be readily apparent to operators at the surface that bit tracking is occurring because the drill bit continues to rotate normally, even though it is not drilling or milling the packer or other material to be drilled.

A downhole tool may be used when it is desirable to seal tubing or other pipe in the casing or wellbore of the well, such as when it is desired to pump cement or other slurry out into a formation. In this situation, it is appropriate to seal the tubing with respect to the well casing and to prevent the fluid pressure of the slurry from lifting the tubing out of the well. Packers, bridge plugs, and the like are designed for these general purposes. Slip mechanisms are devices used on these downhole tools to contact the wellbore and hold the downhole tool in the wellbore without substantial movement, and as discussed above, to hold back fluid or pressure. Typically, the slip mechanism is used to contact the wellbore to hold the downhole tool in the wellbore without substantial movement.

The requirements for slips are that they bite or lock in a tool; the prime example being a packer slip used to lock the packer in a selected position in casing or wellbore. The problem is to make the slips easier to remove by milling or drilling techniques thereby cutting well construction, completion time, and costs.

The prior art slips have been made from gray and ductile types of cast irons. These cast irons are more readily millable/drillable, but still require significant milling/drilling time. More recently, slips have been made with ceramic biting elements glued in composite slip bases. The work in composite slips is promising but unproven because there may be ductility issues with the composite slip base materials. Thus, these solutions, at this point, have provided less than an ideal solution.

In addition, it is known to harden the surface of an aluminum metallic packer by anodizing the surface to form an anodized metallic coating. However, this is problematic because anodization has been found to produce very thin coatings of only a few angstroms or microns. Because this is a relatively thin layer, the slip cannot readily adhere with the substrate.

Therefore, there is a need to have a strong corrosion resistant alloy component for high pressure and high temperature oilfield application, particularly in highly corrosive environments. The general corrosion rate of standard steels can be so high that a component like a slip will corrode past the point of failure. Boronization is used in the oilfield for wear resistance, not hardening.

SUMMARY

In one embodiment, the current invention embodiment is directed to a method of hard surfacing a slip component for a downhole tool. The slip component may have a bearing surface and may be composed of a base material, the base material being metallic. The method may comprise steps of positioning at least the bearing surface of the slip component with a direct contact with a boron source; bonding an external layer at least on the bearing surface to form a metallurgical bond between boron from the boron source with the base material by boriding the base material; and maintaining a bulk temperature of the slip component below a melting point of the base material.

Optionally in any embodiment, maintaining the bulk temperature of the slip component below the melting point comprises maintaining the bulk temperature of the slip component below a temperature where a design strength level of the slip component is compromised.

Optionally in any embodiment, the base material of the slip component comprises nickel super alloys.

Optionally in any embodiment, the nickel super alloy comprises UNS N07718.

Optionally in any embodiment, the method further comprises the step of increasing a hardness of at least a portion of the external layer by surface treating the external layer to induce compressive stresses or relieve tensile stresses.

Optionally in any embodiment, the method further comprises the step of increasing a corrosive resistance of at least a portion of the external layer by surface treating the external layer.

Optionally in any embodiment, surface treating the external layer comprises the step of using a mechanical process selected from the group consisting of peening, shot peening, and burnishing; or using a non-mechanical process selected from the group consisting of ultrasonic peening and laser peening.

Optionally in any embodiment, the slip component comprises at least one slip of a slip mechanism of the downhole tool, and wherein the bearing surface comprises a gripping surface of the at least one slip.

In another embodiment, an exemplary embodiment comprises a slip component for a downhole tool. The slip component is composed of a base material and having a bearing surface, the base material being metallic. At least the bearing surface may be treated by positioning at least the bearing surface relative to a boron source; and bonding an external layer at least on the bearing surface to form a metallurgical bond between the boron source with the base material by boriding the base material and maintaining a bulk temperature of the slip component below a melting point of the base material.

In yet another embodiment, an exemplary embodiment includes a method of hard surfacing a slip component for a downhole tool. The slip component has a bearing surface and is composed of a base material, the base material being metallic. The method may comprise steps of positioning at least the bearing surface of the slip component with a direct contact to a boron source; bonding an external layer at least on the bearing surface by boriding the base material; and increasing a hardness of at least a portion of the external layer by surface treating the external layer to induce compressive stresses or relieve tensile stresses.

BRIEF DESCRIPTION OF THE DRAWINGS

The foregoing summary, as well as the following detailed description of the embodiments, will be better understood when read in conjunction with the appended drawings. It should be understood that the embodiments depicted are not limited to the precise arrangements and instrumentalities shown.

DETAILED DESCRIPTION

Figure 1:
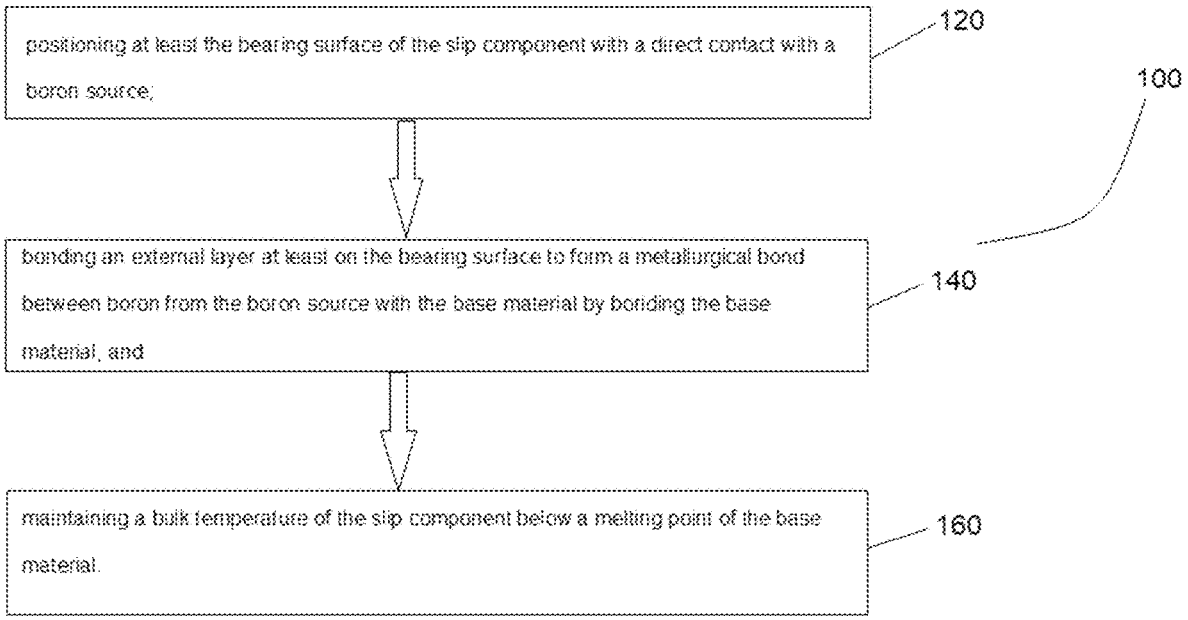
FIG. 1 is a flow chart describing a method of hard surfacing a slip component for a downhole tool according to an embodiment.
Figure 2:
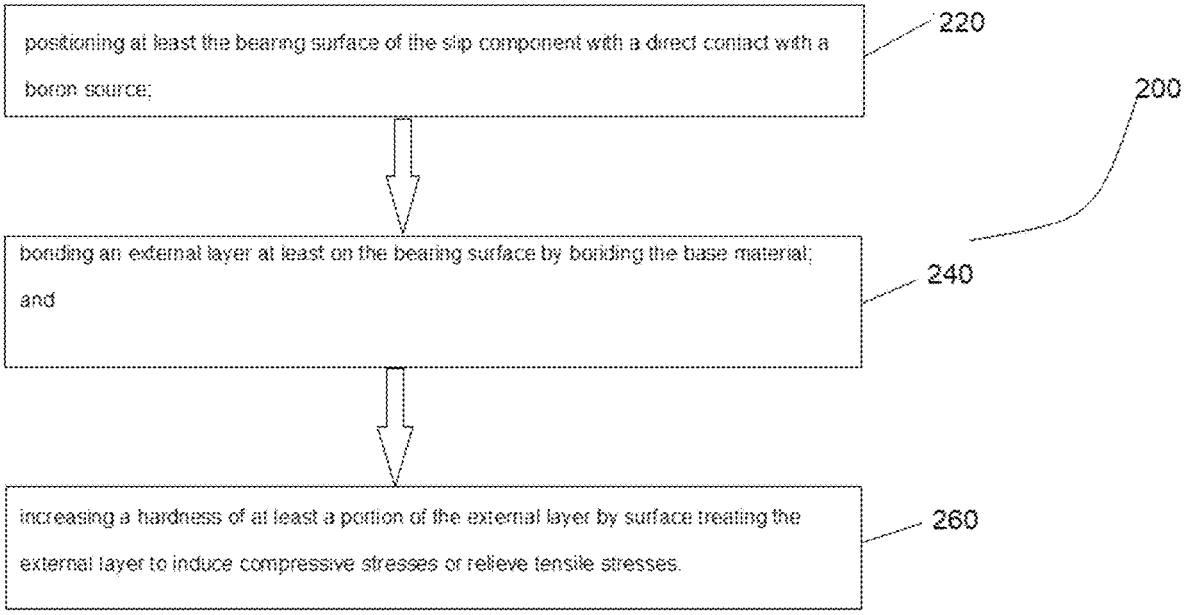
FIG. 2 is a flow chart describing a method of hard surfacing a slip component for a downhole tool according to another embodiment.

Before the description of the embodiment, terminology, methodology, systems, and materials are described; it is to be understood that this disclosure is not limited to the particular terminologies, methodologies, systems, and materials described, as these may vary. It is also to be understood that the terminology used in the description is for the purpose of describing the particular versions of embodiments only, and is not intended to limit the scope of embodiments. For example, as used herein, the singular forms "a," "an," and "the" include plural references unless the context clearly dictates otherwise. In addition, the word "comprising" as used herein is intended to mean "including but not limited to." Unless defined otherwise, all technical and scientific terms used herein have the same meanings as commonly understood by one of ordinary skill in the art.

Unless otherwise indicated, all numbers expressing quantities of ingredients, properties such as size, weight, reaction conditions and so forth used in the specification and claims are to the understood as being modified in all instances by the term "about". Accordingly, unless indicated to the contrary, the numerical parameters set forth in the following specification and attached claims are approximations that may vary depending upon the desired properties sought to be obtained by the invention. At the very least, and not as an attempt to limit the application of the doctrine of equivalents to the scope of the claims, each numerical parameter should at least be construed in light of the number of reported significant digits and by applying ordinary rounding techniques.

As used herein, the term "about" means plus or minus 10% of the numerical value of the number with which it is being used. Therefore, about 50% means in the range of 45%-55%.

A slip component for a downhole tool has a bearing surface that is hard surface treated. The slip component can be a slip or other component of a slip mechanism used on a packer, bridge plug, or other downhole tool. In fact, the slip component can be a slip, a cone, and/or a cage of a slip mechanism of the downhole tool and can even include a portion of a mandrel of the downhole tool adjacent the slip mechanism. Either way, the slip component is composed of a metallic base material having a relatively low melting point compared with steel. For example, the metallic base material of the slip component can be magnesium, aluminum, an aluminum alloy, nickel super alloy or a magnesium alloy. In particular, the nickel super alloy can be a series nickel alloy, such as the UNS N07718.

To hard surface treat the slip component, at least the bearing surface of the slip component is positioned directly in contact with a boron source. The bearing surface can be a gripping surface of a slip used to engage a downhole tubular, although any bearing surface subject to wear, friction, etc. can benefit from the disclosed techniques.

A hardness of at least a portion of the external layer can be increased further by surface treating the external layer to induce compressive stresses or relieve tensile stresses. For example, surface treating the external layer can involve using a mechanical process, such as peening, shot peening, and burnishing, or can involve using a non-mechanical process, such as ultrasonic peening and laser peening.

As shown in FIG. 1, present invention disclosure is directed to a method 100 of hard surfacing a slip component for a downhole tool. The slip component may have a bearing surface and is composed of a base material, the base material being metallic, such as nickel super alloys, for example. The method 100 may comprise steps of positioning at least the bearing surface of the slip component with a direct contact with a boron source at the step 120; bonding an external layer at least on the bearing surface to form a metallurgical bond between boron from the boron source with the base material by boriding the base material at the step 140; and maintaining a bulk temperature of the slip component below a melting point of the base material at the step 160.

In one embodiment, the step 160 of maintaining the bulk temperature of the slip component below the melting point may comprise maintaining the bulk temperature of the slip component below a temperature where a design strength level of the slip component is compromised. In one embodiment, the nickel super alloy may comprise UNS N07718.

In one embodiment, the method 100 may further include the step of increasing a hardness of at least a portion of the external layer by surface treating the external layer to induce compressive stresses or relieve tensile stresses.

In one embodiment, the method 100 may further include the step of increasing a corrosive resistance of at least a portion of the external layer by surface treating the external layer.

In one embodiment, surface treating the external layer may comprise the step of using a mechanical process selected from the group consisting of peening, shot peening, and burnishing; or using a non-mechanical process selected from the group consisting of ultrasonic peening and laser peening.

In one embodiment, the slip component comprise at least one slip of a slip mechanism of the downhole tool, and wherein the bearing surface comprises a gripping surface of the at least one slip.

In another embodiment, the invention embodiment is directed to a method 200 of hard surfacing a slip component for a downhole tool may comprise steps of positioning at least the bearing surface of the slip component with a direct contact to a boron source in the step 220; bonding an external layer at least on the bearing surface by boriding the base material in the step 240; and increasing a hardness of at least a portion of the external layer by surface treating the external layer to induce compressive stresses or relieve tensile stresses in the step 260.

Figure 3:
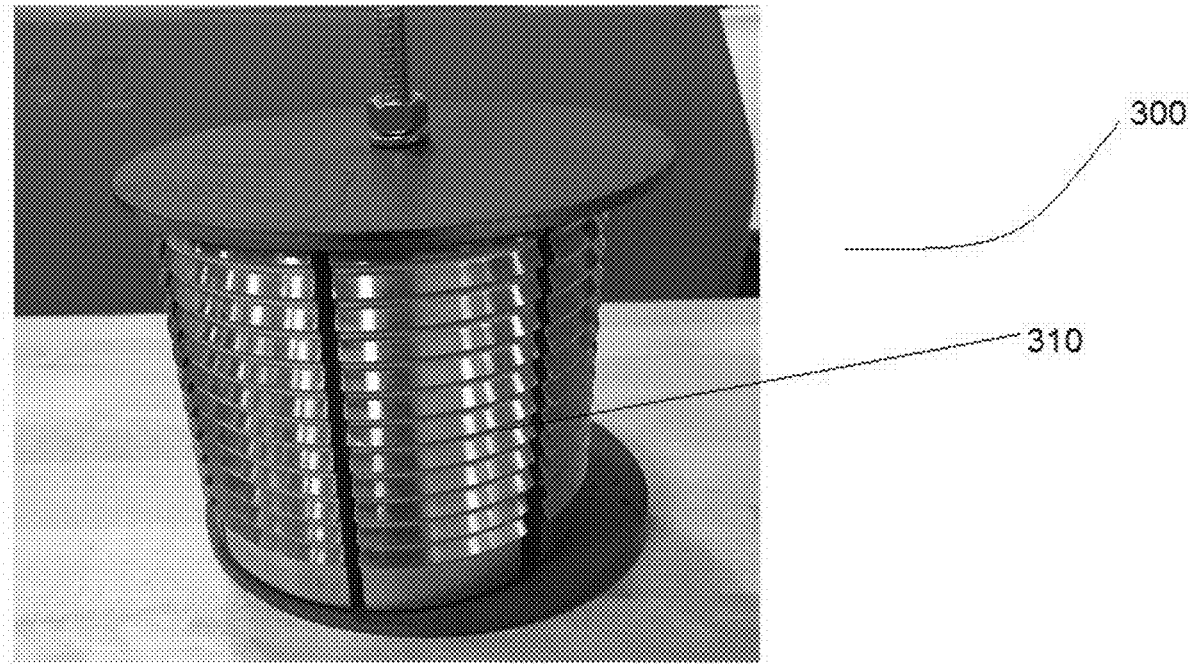
FIG. 3 is a perspective view of a machined slip prior to boronization according to one embodiment.

As shown in FIG. 3, slip machined from UNS N07718 is placed in a fixture to mask the inner surfaces from boronization. Only the profile of the outer diameter must be hardened for the component to grip the casing. A slip component 300 for a downhole tool may be composed of a base material, such as Inconel 718 super alloy, for example, and having a bearing surface 310. The base material is metallic and comprises nickel super alloys, such as UNS N07718. The nickel super alloy comprises nickel-chromium alloy and also significant amounts of iron, niobium, and molybdenum along with lesser amounts of aluminum and titanium.

The Inconel 718 superalloy chemical composition of this alloy may be as follows (all in wt. %): Cr 19.0, Ni 52.4, Mo 3.0, Nb 5.1, Ti 0.9, Al 0.5, Fe 18.5, C 0.08 max., Cu 0.15 max.

Figure 4:
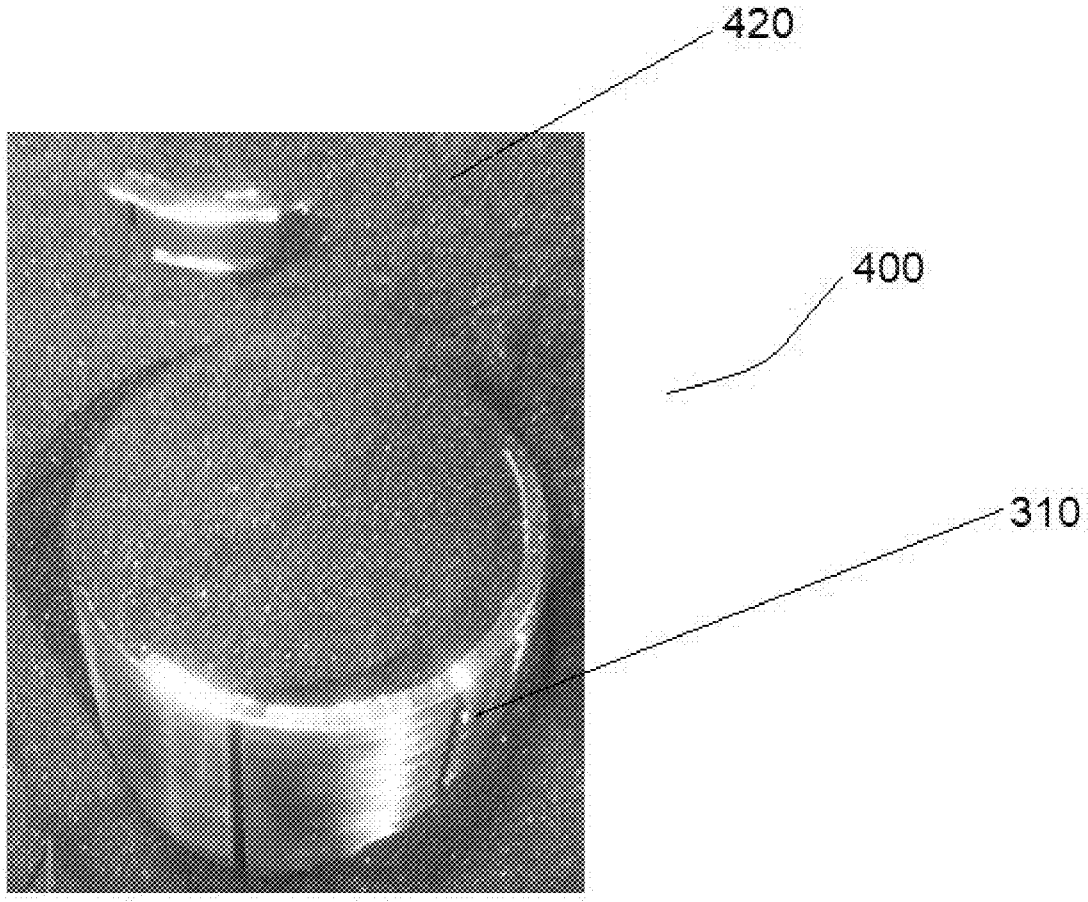
FIG. 4 is a perspective view of slip parts in boron source powder according to one embodiment.

As shown in FIG. 4, two slips are packed in boron powder prior to processing. Parts are fully immersed in powder to ensure full boronization of the profile. At least the bearing surface 310 of the slip component 400 may be treated by positioning at least the bearing surface 310 of the slip component 400 with a direct contact with a boron source 420; and bonding an external layer at least on the bearing surface to form a metallurgical bond between boron from the boron source 420 with the base material by boriding the base material and maintaining a bulk temperature of the slip component below a melting point of the base material.

The boron source may include 10% $B_4C$, 10% KBF and 80% SiC, for example. The thickness of the layers of boronizing powder-mixture below and above the specimen was 20 mm. The packed container was boronized at 950° C. for 1, 2, 4 and 6 h in the electrically heated muffle furnace (followed by cooling it in the air).

For the specimens boronized at 950° C., the top silicide layer on the specimen surface can be uniform or discontinuous depending on the supply of Si from SiC of the boronizing powder mixture to react with Ni at the specimen surface. During boronizing, two competing processes, boride formation and silicide formation, occur. Thermodynamic conditions during the boronizing process decide whether the boride growth dominates or boride-silicide mixed layer grows. Alloy borides may form beneath the silicide layer. This region can be further subdivided into thick needle like boride region and grain-boundary boride region. In the top boride region, a mixture of various borides are present. Grain boundaries are not visible in the top boride region. However, the bottom region shows the borides that are enveloped the grain boundaries and grown in the grains in the form of needles. This bottom region is the boride diffusion front.

The hardness values in the boronized layer can be related to the various boride phases that are identified on the basis of energy dispersive spectroscopy (EDS), X-ray diffraction (XRD) and literature. EDS results confirm the presence of Fe-, Cr- and Ni-borides in the boronized layer. Needle-like structure in the boride layer at the surface region (beneath the silicide layer) is iron borides and chromium borides. This region has the highest microhardness values (1500-2000 HV).

Boronizing Mechanism at 950° C.

Stage 1: Silicide Formation and Boron Diffusion

During boronizing the Inconel 718 superalloy, silicide formation, boron diffusion, borides formation, and the growth of silicide and boride layers occur simultaneously. At boronizing temperature, activator ($KBF_4$) decomposes to form a $BF_3$ gas, which in turn reacts with boron-yielding substance ($B_4C$) to form $BF_2$ gas. At specimen surface, SiC present in the pack mixture reacts with $BF_3$ gas to form $SiF_4$, which reacts with Ni to form the intermetallic compounds (silicides). With the increase in the boronizing time, the thickness of the silicide layer may increase. In the current work, the thickness of the silicide layer is about 10-30 mm. Formation of the phases in the boronized layer during its growth can be presumed on the basis of the microstructure of the cross-section of the boronized specimens. Microstructure that is developed at the interface of the boronized layer and the non-boronized region is possibly an initial stage of the boronizing. Boron has very low solubility in the close-packed lattice of gamma phase, and the planar defects are the easiest path for its diffusion. Therefore, the boron diffusion takes place along the grain boundaries and twin boundaries, where it reduces their interfacial free energy.

Stage 2: Boride Formation

Boron diffused along the grain boundaries forms the alloy borides (Ni-, Cr- and Fe-borides). Based on Gibb's free energy, there is the possibility of the first formation of Cr-borides followed by Ni-borides and then, the simultaneous formation of Fe-borides and silicides. Due to the presence of SiC in the boronizing powder-mixture, Si diffuses in the specimen and forms compound of Ni—Si—B in the boride layer. Once the boron diffusion progresses and the boron potential increases, needles of the alloy borides start forming inside the grains, along with the coarsening of grain boundary borides, and the grain boundary diffusion remains as the boride diffusion front.

Stage 3: Growth of the Borides

As the time progresses, boron concentration gradient along the depth of the cross-section (between the surface and matrix) decreases. This helps in increasing the width and length of the existing borides. Already formed chromium borides and nickel borides get intermixed filling the gaps between them (due to their growth) and form thick uniform boride layer. During this growth, Fe-borides needles form in the boride layer, especially, in the top region of the layer.

Figure 5:
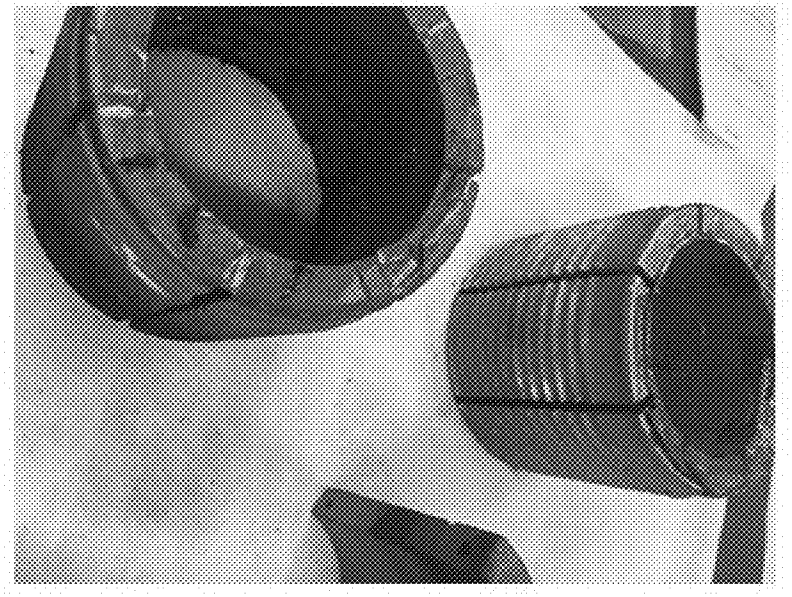
FIG. 5 is a perspective view of slip parts after boronization according to one embodiment.

FIG. 5 has shown the post boronization of super alloy UNS N07718 parts after processing, prior to light bead-blast. After boronizing treatment, the cross-section of the specimens was polished on the automatic polishing machine. Parts are subsequently sand blasted to remove boron powder. The specimens were thoroughly cleaned with soap solution and then, with acetone. Further surface treating the external layer may comprise steps of using a mechanical process selected from the group consisting of peening, shot peening, and burnishing; or using a non-mechanical process selected from the group consisting of ultrasonic peening and laser peening.

The surfaced hardened slip may be used in high pressure high temperature oilfield applications. The slip is made of a boronized corrosion resistant alloy, such as UNS N07718, that provides improved resistance to corrosion in high temperature and high pressure environments commonly found in oil and gas extraction operations.

Figure 6:
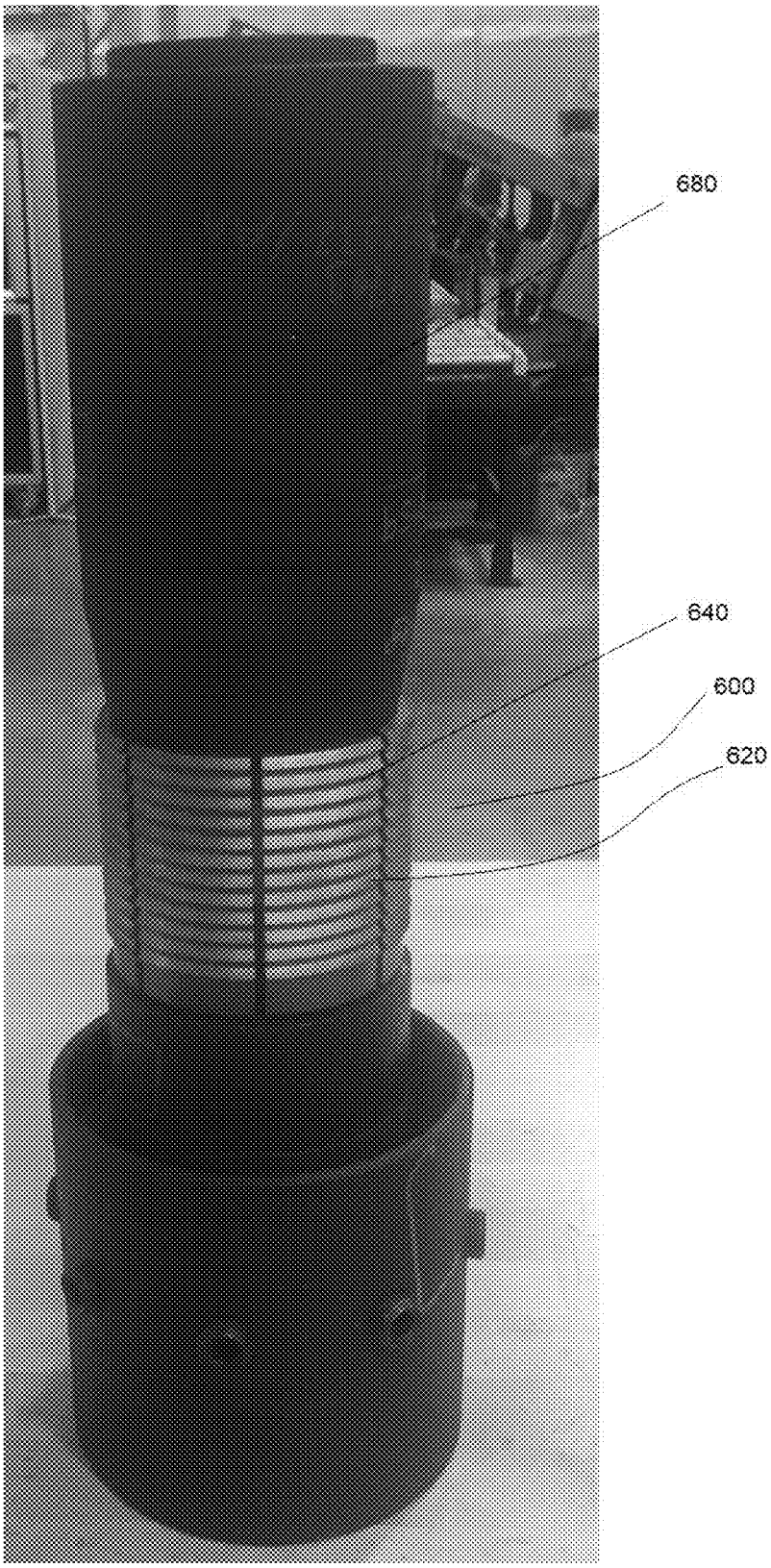
FIG. 6 is a perspective view of slip parts having boronized surface in use according to one embodiment.

As shown in FIG. 6, boronized UNS N07718 slip is placed on test fixture. A casing was subsequently placed over the fixture, resting on the large OD bottom piece. A compressive load was placed on the fixture, expanding the slip to contact the casing, the slip 600 is designed to be used as an anchor for completion packers 660 in a casing (not shown). The slip is made of a boronized corrosion resistant alloy that provides improved resistance to corrosion in high temperature and high pressure environments. The boronization process enhances the corrosion resistance of the alloy by forming a hard and wear-resistant surface layer that provides enhanced protection against corrosion and abrasion.

To allow the slip to penetrate the casing and secure the packer in place, the slip is boronized to improve their resistance to corrosion and abrasion.

The slip is designed to be used in conjunction with completion packers in the casing. The packer is placed in the casing, and the slip is positioned under the packer. The boronized surface of the slip penetrates the casing, anchoring the packer in place. The boronized corrosion resistant alloy provides enhanced protection against corrosion and abrasion, ensuring the slip can securely anchor the packer in place even in high pressure and high temperature environments.

In one embodiment, the slip component may comprise at least one slip of the slip mechanism of the downhole tool having a gripping surface 640 as the bearing surface 620. The slip component may be selected from the group consisting of a slip 600, a cone, and a cage of a slip mechanism of the downhole tool.

Figure 7:
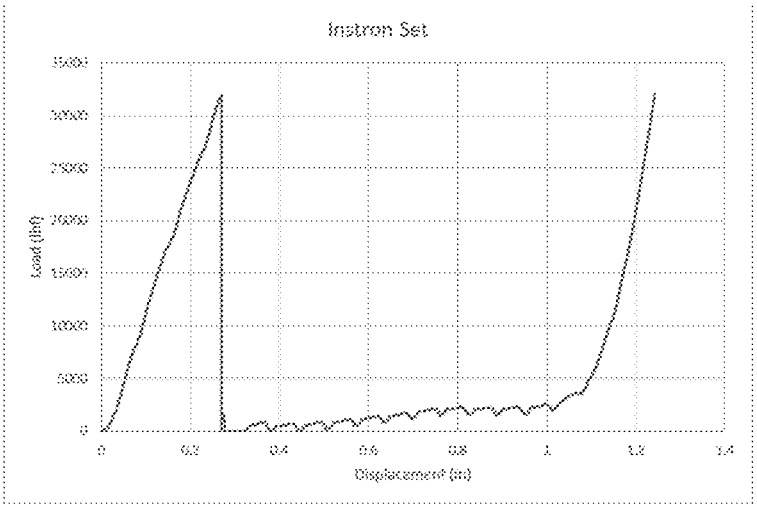
FIG. 7 is a chart showing a loading test performed on the slip shown in FIG. 6.

As shown the testing results in FIG. 7, the first peak shows the load required to expand the slip by pushing it up the cone. The second peak shows the slip contacting and setting into the casing. The hardened surface slip 600 may fit into a packer 680 for testing and has demonstrated a set load at 32000 psi and contact load of 32000 psi for casing penetration. In addition, the design utilizes boronization to achieve vickers hardness above 50 HRC to penetrate V-140 grade casing.

The full load of 299,600 lbs was applied to slip and no movement in the slip observed. The slip was able to maintain the load while not causing swelling in the OD of the casing. The load was released and fixture disassembled to inspect components posttest.

Figure 8:
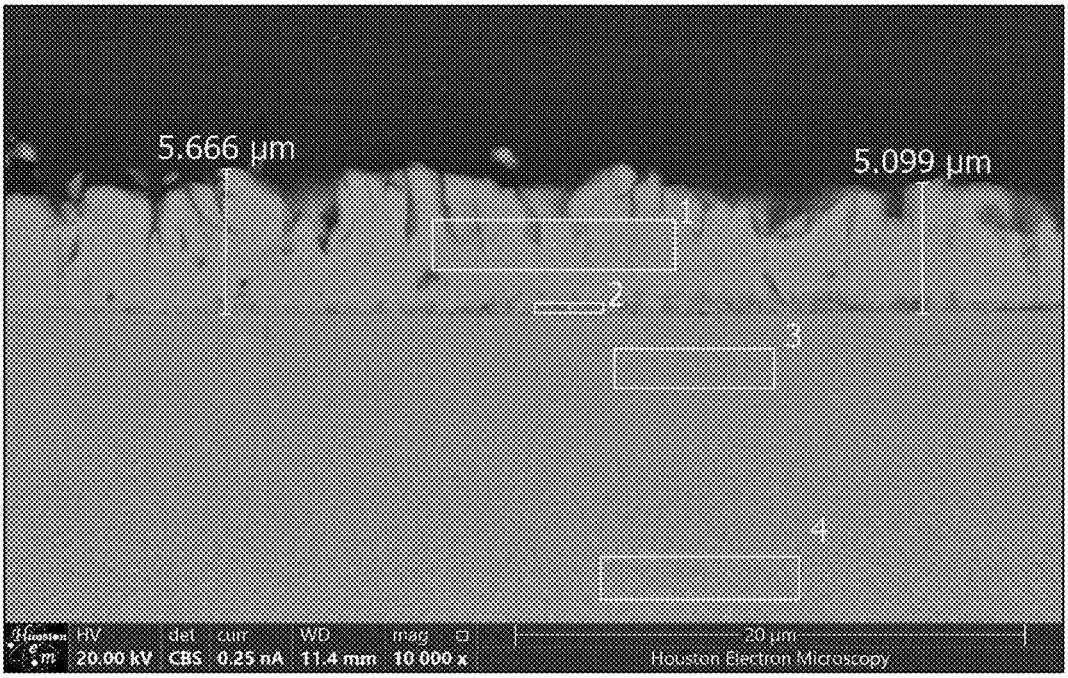
FIG. 8 is a SEM image of cross section view through the boronized coupon at 10× with measurements of thickness and boxed areas of chemistry analysis.

FIG. 8 has shown the cross section view through the boronized coupon at 10× with measurements of thickness and boxed areas such as 1, 2, 3, and 4 boxes of chemistry analysis.

TABLE 1

Semi-quantitative EDS analysis of the areas shown above with significant elements highlighted; Wt. %

| | B | C | O | Si | Ti | Cr | Fe | Ni | Nb | Mo |
|---|---|---|---|---|---|---|---|---|---|---|
| 1 - Nickel-Silicon layer | 5.72 | 10.05 | 0.58 | 10.73 | | 1.41 | 3.08 | 68.43 | | |
| 2 - Thin intermediate layer | 2.00 | 10.07 | 4.07 | 4.99 | 0.32 | 10.05 | 15.14 | 49.41 | 2.34 | 1.60 |
| 3 - Boronized layer | 3.29 | 7.47 | | 2.76 | 1.10 | 20.72 | 23.29 | 31.72 | 6.32 | 3.15 |
| 4 - Substrate, 718 steel | 1.71 | 6.43 | | 0.29 | 1.10 | 20.42 | 19.73 | 40.80 | 5.69 | 3.22 |

Figure 9:
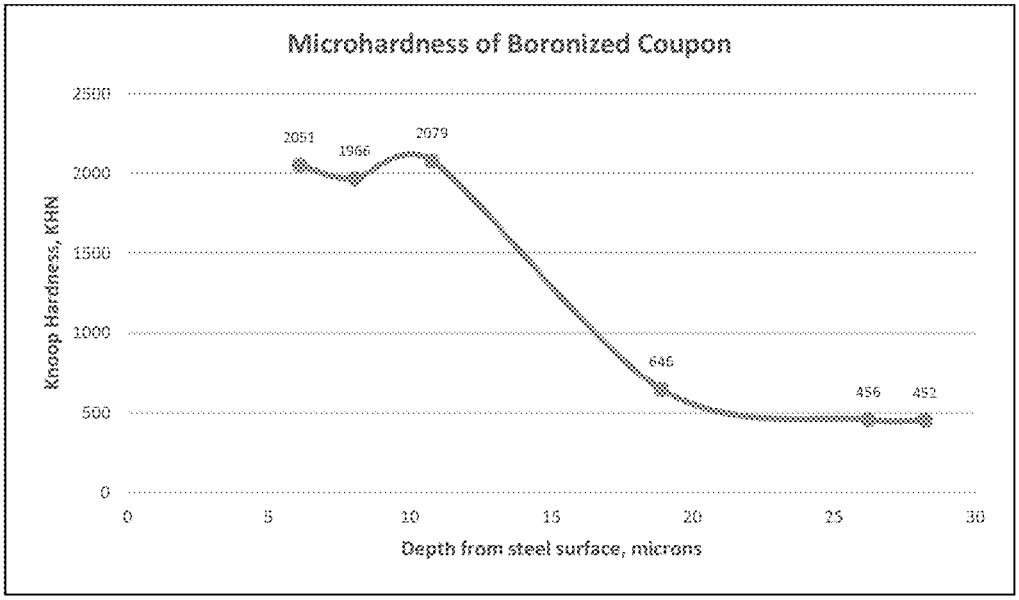
FIG. 9 is microhardness profile as a function of depth for boronized coupon.

FIG. 9 has shown the microhardness profile as a function of depth for boronized coupon. At the depth of around 10 microns, the Knoop hardness reaches the highest point 2079. The deeper it goes, less hardness it will get.

Inconel 718 boronized slip performs much better than alloy steel 8620 slip. Some differences between the boronized slip test and carburized slips are that the higher break force is required for the Inconel 718 slip. The alloy steel 8620 slip breaks at 7,700 lbs compared with 32,000 lbs on the Inconel 718 slip. Both have the same break area.

Slip penetration into casing lower in comparison with the alloy steel 8620 carburized slip. The carburized slip maximum penetration was about 0.040" and shallowest measured was about 0.010". The boronized slip was about 0.01215" maximum and the shallowest measured was about 0.00465". The boronized case depth is less than the carburized. It is non-evident that a substantially shallower depth would provide sufficient depth of hardness to penetrate casing. The slip hardness must exceed the casing hardness by 5 HRC, with the underlying material neither deforming or cracking. Carburized case depth ranges from about 0.01" to about 0.200", with hardness exceeding about 60 HRC. The boronized layer thickness ranges between about 0.0005"-about 0.001", also with a hardness exceeding about 60 HRC. However, the underlying nickel alloy is substantially softer than the casing (about <41 HRC). A skilled practitioner would expect the case depth inadequate to prevent deformation of the bulk material, thus failing to bite into the casing.

The testing conclusively demonstrated that a boronized nickel alloy component may adequately penetrate even the highest hardness oilfield casing.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, no clauses are intended to be in the means-plus-function format allowed by 35 U.S.C. § 112, paragraph 6 unless "means for" is explicitly recited together with an associated function. "Means for" clauses are intended to cover the structures described herein as performing the recited function and not only structural equivalents, but also equivalent structures.

The above shows and describes the basic principles, main features and advantages of the utility patent application. Those skilled in the industry should understand that the present utility patent application is not limited by the above-mentioned embodiments. The above-mentioned embodiments and the description are only preferred examples of the present utility patent application and are not intended to limit the present utility patent application, without departing from the present utility patent application. Under the premise of spirit and scope, the present utility patent application will have various changes and improvements, and these changes and improvements fall within the scope of the claimed utility patent application. The scope of protection claimed by the utility patent application is defined by the appended claims and their equivalents.

We claim:

1. A method of hard surfacing a slip component for a downhole tool, the slip component having a bearing surface and being composed of a base material, the base material being metallic, the method comprising:

positioning at least the bearing surface of the slip component with a direct contact with a boron source having 10% $B_4C$, 10% KBF and 80% SiC, wherein the boron source maintains in a non-molten state;

bonding an external layer at least on the bearing surface to form a metallurgical bond between boron from the boron source with the base material by boriding the base material; and maintaining a bulk temperature of the slip component below a melting point of the base material.

2. The method of claim 1, wherein maintaining the bulk temperature of the slip component below the melting point comprises maintaining the bulk temperature of the slip component below a temperature where a design strength level of the slip component is compromised.

3. The method of claim 1, wherein the base material of the slip component comprises nickel super alloys.

4. The method of claim 3, wherein the nickel super alloy comprises UNS N07718.

5. The method of claim 1, further comprising increasing a hardness of at least a portion of the external layer by surface treating the external layer to induce compressive stresses or relieve tensile stresses.

6. The method of claim 1, further comprising increasing a corrosive resistance of at least a portion of the external layer by surface treating the external layer.

7. The method of claim 5, wherein surface treating the external layer comprises:

using a mechanical process selected from the group consisting of peening, shot peening, and burnishing; or using a non-mechanical process selected from the group consisting of ultrasonic peening and laser peening.

8. The method of claim 1, wherein the slip component comprise at least one slip of a slip mechanism of the downhole tool, and wherein the bearing surface comprises a gripping surface of the at least one slip.

9. A slip component for a downhole tool, the slip component being composed of a base material and having a bearing surface, the base material being metallic, at least the bearing surface treated by: positioning at least the bearing surface of the slip component with a direct contact with a boron source having 10% $B_4C$, 10% KBF and 80% SiC, wherein the boron source maintains in a non-molten state; and bonding an external layer at least on the bearing surface to form a metallurgical bond between boron from the boron source with the base material by boriding the base material and maintaining a bulk temperature of the slip component below a melting point of the base material.

10. The slip component of claim 9, wherein maintaining the bulk temperature of the slip component below the melting point comprises maintaining the bulk temperature of the slip component below a temperature where a design strength level of the slip component is compromised.

11. The slip component of claim 9, wherein the base material of the slip component comprises nickel super alloys.

12. The slip component of claim 11, wherein the nickel super alloy comprises UNS N07718.

13. The slip component of claim 9, wherein the at least the bearing surface treated further comprising increasing a hardness of at least a portion of the external layer by surface treating the external layer to induce compressive stresses or relieve tensile stresses.

14. The slip component of claim 9, wherein the slip component comprises at least one slip of a slip mechanism of the downhole tool having a gripping surface as the bearing surface.

15. The slip component of claim 9, wherein the slip component is selected from the group consisting of a slip, a cone, and a cage of a slip mechanism of the downhole tool.

16. A method of hard surfacing a slip component for a downhole tool, the slip component having a bearing surface and being composed of a base material, the base material being metallic, the method comprising:

positioning at least the bearing surface of the slip component with a direct contact to a boron source having 10% $B_4C$, 10% KBF and 80% SiC, wherein the boron source maintains in a non-molten state;

bonding an external layer at least on the bearing surface by boriding the base material; and increasing a hardness of at least a portion of the external layer by surface treating the external layer to induce compressive stresses or relieve tensile stresses.

17. The method of claim 16, wherein surface treating the external layer comprises:

using a mechanical process selected from the group consisting of peening, shot peening, and burnishing; or using a non-mechanical process selected from the group consisting of ultrasonic peening and laser peening.

18. The method of claim 16 further comprising the step of increasing a corrosive resistance of at least a portion of the external layer by surface treatment.

19. The method of claim 16 further comprising the step of maintaining a bulk temperature of the slip component below a melting point of the base material.

20. The method of claim 16, wherein maintaining the bulk temperature of the slip component below the melting point comprises maintaining the bulk temperature of the slip component below a temperature where a design strength level of the slip component is compromised.

* * * * *